United States Patent [19]

Imamura et al.

[11] Patent Number: 4,490,415

[45] Date of Patent: Dec. 25, 1984

[54] METHOD OF COATING A PENCIL

[75] Inventors: Kazuyoshi Imamura; Koichi Yasui, both of Miyazaki; Akeomi Saito, Yamagata, all of Japan

[73] Assignee: Asahi Kasei Kogyo Kabushiki Kaisha, Osaka, Japan

[21] Appl. No.: 415,724

[22] Filed: Sep. 7, 1982

Related U.S. Application Data

[63] Continuation of Ser. No. 191,144, Sep. 26, 1980, abandoned.

[51] Int. Cl.[3] ..... B05D 1/18; B05D 3/12

[52] U.S. Cl. ..... 427/358; 427/408; 427/434.6; 427/434.7; 427/440; 428/375; 428/480; 428/481; 401/49; 401/88

[58] Field of Search ..... 401/49, 88; 428/375, 428/376, 395, 361, 537, 481, 480; 427/374.1, 434.6, 434.7, 440, 408, 358; 528/302; 264/45.9, 46.1, 174

[56] References Cited

U.S. PATENT DOCUMENTS

| | | | |
|---|---|---|---|
| 1,421,535 | 7/1922 | Murdock | 401/88 |
| 3,085,920 | 4/1963 | Taylor et al. | 428/481 |
| 3,202,133 | 8/1965 | Platzman | 401/49 |
| 3,232,277 | 2/1966 | McPhee | 401/88 |
| 3,423,280 | 1/1969 | Wienes | 428/481 |
| 3,863,000 | 1/1975 | Kasai et al. | 264/45.9 |
| 3,985,711 | 10/1976 | Cohen et al. | 528/302 |
| 3,998,979 | 12/1976 | Armstrong et al. | 428/481 |
| 4,059,715 | 11/1977 | Pletcher | 427/385.5 |
| 4,072,662 | 2/1978 | van der Linde et al. | 528/302 |
| 4,101,496 | 7/1978 | Dorffel et al. | 528/302 |
| 4,124,571 | 11/1978 | Georgoudis | 528/302 |
| 4,140,729 | 2/1979 | Tobias et al. | 528/302 |
| 4,156,774 | 5/1979 | Buxbaum et al. | 528/302 |

FOREIGN PATENT DOCUMENTS

| | | | |
|---|---|---|---|
| 2737538 | 2/1978 | Fed. Rep. of Germany | 401/88 |
| 2845078 | 4/1980 | Fed. Rep. of Germany | 401/49 |
| 5309135 | 7/1971 | Japan | 401/49 |
| 49-51326 | 5/1974 | Japan . | |
| 52-41027 | 3/1977 | Japan . | |

*Primary Examiner*—Richard Bueker

*Attorney, Agent, or Firm*—Armstrong, Nikaido, Marmelstein & Kubovcik

[57] ABSTRACT

Coating of the surface of a pencil barrel with a coat film having a sufficient thickness and smoothness can be well achieved by using a hot-melt polyester as a coating material. The formation of the desired coat film on the pencil barrel can be attained even by only a single coating operation. The coat film of hot-melt polyester formed on the surface of the pencil barrel has an excellent affinity for and an improved adhesion to not only a pencil barrel but also to a lacquer if any lacquer is additionally coated on the polyester-coated pencil barrel. Any organic solvent need not be used, and the coating operation can be completed in an extremely short time. Therefore, the method of the present invention is very advantageous from the viewpoints of prevention of environmental pollution and enhancement of productivity.

10 Claims, 3 Drawing Figures

METHOD OF COATING A PENCIL

This is a continuation of application Ser. No. 191,144, filed Sept. 26, 1980, now abandoned.

The present invention relates to a method of coating a pencil. More specifically, it pertains to a method of coating a pencil in which a hot-melt polyester is used as a coating material, and has, for its primary object, to provide a pencil barrel, on its surface, with a coating film having a sufficient thickness and smoothness and exhibiting good adhesion to various types of lacquers even by only a single coating, thereby enjoying numerous advantages such as increased productivity in pencil coating processes, simplification of coating steps, reduction in coating space, a safer and cleaner working atmosphere and elimination of problems of discharged gases from the environment of factories or plants.

In the conventional method of coating a pencil, a lacquer is usually employed. In order to attain a lacquer film having a usually desired thickness of 50 to 120 microns, however, it is necessary to repeat coating six to ten times or, in some cases, more times. In addition, a single coating time required for a cycle of coating and drying and preparation for the next coating is at least several minutes and, in some cases, as long as 20 to 30 minutes. A drying equipment used occupies a space having a length as large as over ten meters. Therefore, the conventional pencil coating method not only is low in productivity and requires a large coating space, but also has great problems in connection with environmental pollution caused by evaporation of solvents during drying and air pollution in the environment of factories or plants due to the waste discharged therefrom.

In order to obviate these defects, it has heretofore been proposed to coat a pencil barrel with a solvent-free type thermoplastic resin admixed with a paraffin wax or rosin and a pigment (see Japanese Patent Application Laid-Open Specification No. 51326/1974). The solvent-free type thermoplastic resin as proposed in the prior art is a copolymer of ethylene and a vinyl acetate monomer. However, a coating film based on this resin is so soft and fragile that it may suffer failure or peeling off when sharpening a pencil. Such a coating film is also of a dim gloss. When a brightener such as transparent lacquer is coated on the film to improve the gloss thereof, peeling may occur between the coatings in sharpening a pencil because one coating has a poor affinity for the other. The coating film based on such resin also has a lower softening point so that, when a pencil is accidentally left to stand in a high-temperature atmosphere or at a site exposed to direct sunlight during use, there may be a fear that the coating is caused to melt, resulting in unfavorable sticking of the pencil to another pencil. Thus, the abovementioned solvent-free type resin offers various problems from a practical standpoint.

Japanese Patent Application Laid-Open Specification No. 41027/1977 proposes a method in which a polyamide type hot-melt resin prepared by the reaction of a polymerized fatty acid with an aliphatic polyamine or an admixture of said polyamide type hot-melt resin with a hydroxyl-containing compound is applied onto a pencil barrel by hot-melt coating. However, the polyamide type hot-melt resin gives rise to a problem with respect to the tinge of a white- or light-colored paint, since the hue thereof assumes a yellowish brown or brown color. This resin is poor in adhesion to a lacquer and, therefore, liable to cause the overcoated lacquer to peel off. For this reason, this resin cannot be put to practical use without recourse to specially designed means. Further, due to the hygroscopicity of this resin, it is likely that the smoothness of a coating film is deteriorated by bubbling of water caused to be included in the resin during the coating operation and that the lacquer coating film undergoes discoloration by bleeding of paraffins and dyes contained in a pencil barrel into a lacquer film. Such bleeding cannot be avoided by any means. This resin also has a disadvantage that it suffers heat deterioration such as discoloration or decomposition during its being molten by heat. Thus, this resin leaves much to be improved.

U.S. Pat. No. 3,524,759 Specification states that the so-called falling curtain process making use of a composition consisting essentially of 80 to 95% by weight of a polyethylene type copolymer and 5 to 20% by weight of a crystalline polymer of an $\alpha$-olefin is applicable to the coating of a pencil barrel. The composition referred to therein is essentially similar in essential physical properties to the aforementioned copolymer of ethylene and vinyl acetate and, hence, it is still insufficient from a practical standpoint.

As a result of extensive and intensive investigations carried out with a view to eliminating the above-mentioned disadvantages unavoidably accompanying the conventional methods of coating a pencil, it has surprisingly been found that a hot-melt polyester (which will be explained later in more detail) exhibits good coating performance when it is used in coating a pencil and can provide a coating film having excellent coating characteristics. This novel finding has led to accomplishment of the present invention.

Accordingly, it is an object of the present invention to provide a method of coating a pencil which is capable of providing the pencil barrel, on its surface, with a coating film having excellent coating characteristics such as sufficient thickness and smoothness even by only a single coating.

It is another object of the present invention to provide a method of coating a pencil of the above kind, which is capable of forming a coating film having a good adherence to a lacquer if any lacquer is coated thereon.

It is still another object of the present invention to provide a method of coating a pencil of the character described, which can be conducted with a high productivity and without any fear of environmental pollution.

The foregoing and other objects, features and advantages of the present invention will be apparent to those skilled in the art from the following detailed description and appended claims taken in connection with the accompanying drawings in which:

Figure 1:
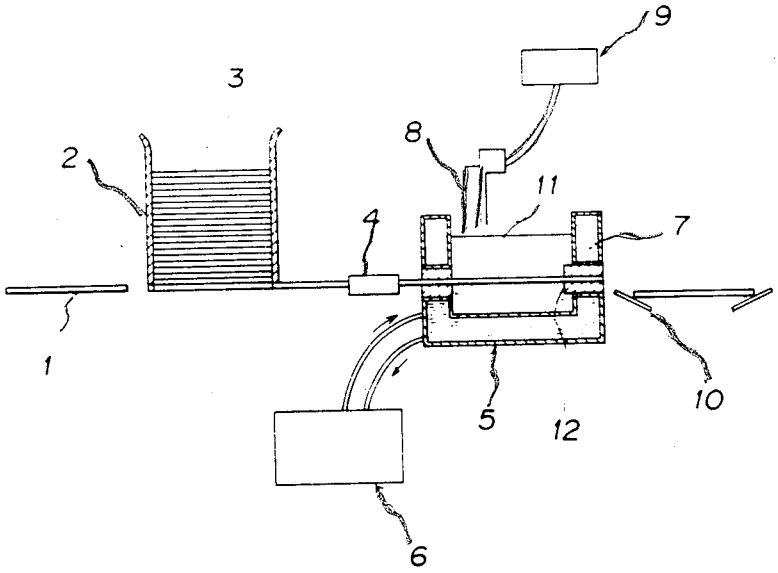
FIG. 1 is a diagrammatic side view of a preferred apparatus or arrangement for practicing the method of the present invention, partly shown in cross-section for easy understanding.

Essentially, according to the present invention, there is provided a method of coating a pencil which comprises applying onto the surface of a pencil barrel a hot-melt polyester which is molten at a temperature higher than the softening point thereof, followed by cooling for solidification of the hot-melt polyester.

The polyester used in the method of the present invention is easily applied onto a pencil barrel, since it melts upon being heated to a temperature higher than its softening point due to the thermoplasticity thereof. The polyester exhibits good adhesion to a pencil barrel and forms a uniform coating film thereon owing to the good affinity for the pencil barrel. In addition, the polyester is colorless or of white color so that it can well be colored with a coloring agent. Furthermore, since the polyester undergoes no or little cobwebbing just after coating, a pencil barrel is free of any bad appearance due to cobwebbing. Due to the extremely good thermal stability, the polyester suffers only a little viscosity change in the atmosphere under such molten conditions as 200° C. for 48 hours, and experiences neither skinning nor discoloration. The coating film based on the polyester hardly sticks to the hand, and undergoes no blocking under usual circumstances. The polyester can also prevent bleeding of dyes and low-melting-point paraffins present in a pencil barrel. The polyester exhibits excellent affinity for and good adhesion to not only a lacquer composed mainly of a cellulose-based resin such as nitrocellulose, acetyl cellulose, ethyl cellulose or the like and containing a suitable amount of a synthetic resin such as polyacrylate, alkyd resin, polyurethane, nylon, polyester, polyvinyl acetate, a copolymer of vinyl acetate and vinyl chloride, rosin, rosin derivatives or the like, but also an enamel lacquer prepared by adding a dye and/or pigment to the above-mentioned lacquer. Accordingly, the polyester has various advantages, for example, it does not peel off from pencils coated therewith during the production and use of such pencils.

The term "hot-melt polyester" used herein is intended to mean a polyester composed mainly of polyvalent carboxylic acids and polyvalent alcohols. Examples of the hot-melt polyester include polyesters prepared by copolymerization of acid components such as terephthalic acid, isophthalic acid, succinic acid, glutaric acid, adipic acid, azelaic acid, sebacic acid, 1,10-decane dicarboxylate and/or 1,2-bis(p-carboxyphenoxy) ethane and alcohol components such as ethylene glycol, 1,4-buranediol, 1,6-hexanediol, neopentyl glycol, 1,2-propanediol, 1,3-propanediol, 1,5-pentanediol, diethylene glycol, bisphenol A and/or 2,2-bis[p-(β-hydroxyethoxy)phenyl]propane, and polyester ethers prepared by copolymerization of polyalkylene ethers such as polyethylene glycol. All the above-mentioned polyesters are found to be suitable for use in the method of coating a pencil according to the present invention. More particularly, it is preferred that use be made of a polyester having a softening point of 70° to 200° C. and a melt viscosity of 100 to 100,000 centipoises as measured at a temperature 30° C. higher than its softening point from the standpoint of ease in setting the melt temperature in coating, an optimum viscosity and easy preparation of a paint. Illustratively stated, the softening point of the polyester is advantageously 70° C. or more since, even when a pencil is accidentally left in a high-temperature atmosphere during use, it is possible to prevent softening of the surface coating resin, which softening leads to formation of a roughened surface. The upper limit of the softening point of the polyester is advantageously 200° C. from the standpoint that the melt temperature of resin under the action of heat should not be higher than an economical temperature. On the other hand, the melt viscosity of the polyester in the range of 100 to 100,000 centipoises is advantageous for formation of a thicker coating film and ready control of thickness.

More preferably, use is made of a polyester containing, as the carboxylic acid components, 20 to 95 mole % of terephthalic acid monomer units and 5 to 80 mole % of a member selected from the group consisting of isophthalic acid monomer units, monomer units of a straight chain or branched saturated aliphatic dicarboxylic acid having 4 to 20 carbon atoms and combinations thereof, and, as the alcohol components, glycol monomer units of at least one member selected from the group consisting of ethylene glycol, 1,3-propanediol, 1,4-butanediol, 1,5-pentanediol and 1,6-hexanediol. This is so because no blocking of a coating film takes place just after coating. Most preferably, use is made of a polyester consisting of 1,4-butanediol monomer units and carboxylic acid monomer units comprising 40 to 65 mole % of terephthalic acid monomer units, 10 to 40 mole % of isophthalic acid monomer units and 10 to 40 mole % of monomer units of at least one saturated dicarboxylic acid selected from the group consisting of straight chain or branched saturated aliphatic dicarboxylic acids having 4 to 12 carbon atoms. This is so because this polyester is solidified in a very short period of time to provide a coating film showing no sign of blocking. In general, the coating rate in the application of a hot-melt resin onto a pencil barrel varies depending upon a solidification time required for the formation of a practical coating film by cooling the molten resin applied onto the barrel. The solidification time may optionally be controlled by the coating temperature applied, the desired thickness of a coating film and the cooling conditions applied. On the other hand, however, it is very important to permit easy solidification of the hot-melt resin itself. In this respect, the aforesaid class of polyester is most recommendable.

The temperature at which the present hot-melt material is used for coating a pencil is not critical, but there may usually be employed a temperature about 10° to about 60° C. higher than the softening point of the hot-melt material.

With respect to the hot-melt polyesters to be employed in the method of the present invention, it is very difficult to generically define the range of molecular weight or polymerization degree because the different kinds of acid components may be employed in varied proportions. If it is taken into consideration that the hot-melt polyester is used for coating a pencil and that the melt viscosity has an indirect relationship with the polymerization degree, the value of melt viscosity as measured at a temperature 30° C. higher than the softening point thereof is sufficient to define the hot-melt polyester of the present invention in this aspect.

The polyester to be used in the method of the present invention may be prepared in known manner without recourse to any special polymerization method. The acid components, e.g., terephthalic acid, isophthalic acid, an aliphatic dicarboxylic acid and/or an ester-forming derivative thereof may be subjected in one-stage or stepwise manner to a direct esterification reaction or an ester interchange reaction with at least one of the aforesaid glycols, followed by polymerization. In preparing the polyester, use may be made of various known catalysts, stabilizers, modifiers and additives as disclosed in, for example, U.S. Pat. No. 4,059,715 Specification.

The hot-melt polyester to be used in the method of the present invention may be those prepared by incorporating a variety of suitable additives into the aforesaid thermoplastic polyester. The additives to be used for this purpose may include, e.g., higher alcohols, higher fatty acids, fats and oils, waxes, resins, metallic soaps, liquid polymers, oligomers, plasticizers, coloring agents, inorganic and organic fillers, antioxidants, antistatic agents, ultraviolet absorbers and the like. As examples of the higher alcohols, there can be mentioned myristyl, cetyl, stearyl and oleyl alcohols, and as examples of the higher fatty acids, there can be mentioned lauric, myristic, palmetic, stearic and oleic acids. Examples of the fats and oils include castor oil and cottonseed oil, and examples of the waxes include low molecular weight polyethylene, paraffin wax and microcrystalline wax. As the resins, there can be mentioned hydrogenated petroleum resin, terpene resin, terpene phenol resin, epoxy resin, rosin or a resin derived therefrom, petroleum resin and the like. Examples of the metallic soaps include zinc stearate and calcium stearate. Examples of the liquid polymers include liquid polysulfide, liquid polybutadiene and liquid polychloroprene. Examples of the oligomers include epoxy oligomer, acryl oligomer and urethane oligomer. As the plasticizers, mentioned are phthalates such as dibutyl phthalate, dioctyl phthalate and di-2-ethylhexyl phthalate, adipates such as di-2-ethylhexyl adipate and di-isooctyl adipate, sebacates such as dibutyl sebacate and dioctyl sebacate, polyester type plasticizers such as polypropylene adipate and polypropylene sebacate, polyethylene glycol and the like. As the coloring agents, inorganic and organic fillers, use may be made of heat-resistant dyes and pigments; talc, kaolin, calcium carbonate, magnesium carbonate, barium sulfate, clay etc.; and synthetic fibers, cellulose etc.; respectively.

The amounts of the above-mentioned additives may vary depending upon the degree of pigmentation, the desired hardness of a coating film, the desired viscosity of a coating material, the presence of other additives and the like factors. In general, the higher alcohols, higher fatty acids, fats and oils, waxes, resins, metal soaps, liquid polymers or oligomers and plasticizers each are preferably used in an amount of 0.5 to 20% by weight based on the final hot-melt polyester whether they are used alone or in combination of two or more thereof. The antioxidants, antistatic agents and UV absorbers each are preferably used in an amount of 0.1 to 0.5% by weight based on the final hot-melt polyester. The coloring agents and inorganic and organic fillers each are preferably employed in an amount of 5 to 60% by weight, more preferably 5 to 40% by weight based on the final hot-melt polyester whether they are used alone or in combination of two or more thereof.

In practicing the method of the present invention, it is recommendable to use a polyester admixed with, in particular, the aforesaid higher alcohols, higher fatty acids, fats and oils, waxes or plasticizers. When only the molten hot-melt polyester without the above-mentioned additives is applied onto a pencil barrel by dip coating, the air and moisture contained in the interior of the barrel, especially a portion thereof adjacent the surface, are heated and are apt to escape through the hot-melt polyester coat film being formed. Although this coating film is solidified in a moment, yet a part of air bubbles may remain imminent on the surface of the film, thus leading to deterioration of the coating of the pencil. As a result of intensive studies made on the bubble problem, it has been found that a smooth coating film which is not affected by air bubbles can be obtained by the use of the hot-melt polyester in which a higher alcohol, higher fatty acid, fat and oil, wax and/or plasticizer is incorporated.

In carrying out the present invention, it is further advantageous to use a hot-melt polyester admixed with a coloring agent and inorganic and organic fillers. Since the polyester is colorless or white, the color of the coloring agent incorporated can be developed as such. Accordingly, if the polyester pre-mixed with such coloring agent is applied, it is possible to decrease the number of coating of enamel lacquer. The inorganic or organic fillers not only serve as an extender, but also, like the plasticizer, promote removal of air bubbles from the coating film. Thus, the incorporation of these fillers is very advantageous for pencil coating.

According to the present invention, no special limitation is imposed on the method for coating a pencil barrel with the hot-melt polyester. That is, the polyester is molten at a temperature higher than the softening point thereof and applied onto an object or material to be subjected to coating according to any method known in the art, such as a dip coating, a roll coating, a calender coating, an extrusion coating, a curtain coating or a spray coating. Of them, however, a dip coating method is most preferred. It will be understood that the equipment to be used is somewhat different from the prior art coating apparatus. First, the equipment comprises a coating vessel provided with a heater or a heating jacket adapted to receive therein a melt medium such as a heated oil, thereby melting a hot-melt polyester and maintaining the molten polyester at a constant temperature. Second, any drying device can be dispensed with.

The present invention will now be elucidated with reference to FIG. 1 illustrating one form of an arrangement for practicing the method of the present invention in which a heating jacket is employed for heating a coating vessel. In FIG. 1, numeral 1 designates a plunger rod, 2 a hopper, 3 a pencil barrel, 4 a feed roll, 5 a coating vessel for hot-melt coating (equipped with a jacket), 6 a circulator for a constant-temperature heat medium, 7 an insulated jacket using a heat medium, 8 a level detection float, 9 a hot-melt applicator, 10 a belt conveyor, 11 a hot-melt polyester and 12 a wiping rubber die.

Pencil barrels 3 fed into the hopper 2 are pushed out one by one by means of plunger rod 1, and are then supplied into the coating vessel 5 through the feed roll 4. The pencil barrel 3 is passed through the hot-melt polyester 11 in the vessel 5. Excess hot-melt polyester is removed by means of the wiping rubber die 12. Upon dip coating, the coated pencil barrel 3 is placed on the belt conveyor 10. Thus, a single coating cycle is completed.

According to the present invention, upon coating of the hot-melt polyester, a lacquer may be additionally applied onto the pencil barrel once coated with the hot-melt polyester. As the lacquer to be applied, mention is made of cellulose derivatives such as nitrocellulose, acetyl cellulose, ethyl cellulose or the like, which may optionally be admixed with rosin, a synthetic resin such as polyacrylate or the like. The lacquer may also contain a plasticizer, pigment, etc, if desired.

An ordinarily effected, the application of lacquer onto the hot-melt coated barrel may be conducted by spraying or dipping without recourse to any special means.

A first effect attained by the present invention resides in that a thick coating film having a thickness on the order of several-ten microns can be obtained by only a single coating with no need of dyring. This gives rise to a considerable increase in productivity and substantial reduction in space for coating as compared with the prior art method. The nonuse of any solvent also ensures a safer and cleaner working atmosphere, thus leading to prevention of environmental pollution in the factories or plants. A second effect of the present invention resides in that no peeling occurs not only between the polyester film and the pencil barrel but also between the polyester film and the lacquer film during the production and use of pencil, since the polyester film exhibits good adhesion to both the pencil barrel and the lacquer film, and that the hot-melt polyester-coated pencil barrel, especially white- or light-colored, suffers no discoloration since the coated barrel shows no sign of bleeding of paraffins and dyes therefrom. Accordingly, the present invention can provide a high quality pencil.

The present invention will now be illustrated in more detail with reference to the following Examples that should not be construed to be limiting the scope of the present invention.

The physical properties of the hot-melt polyesters mentioned in the Examples and Comparative Examples were measured according to the following methods.

1. Softening Point

Measurement was done according to ASTME-28-51T.

Figure 2:
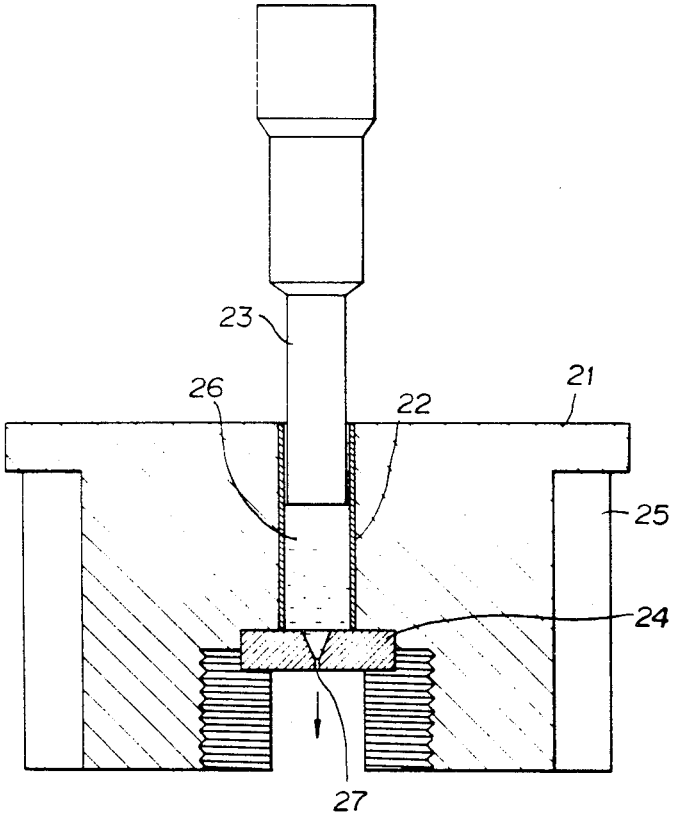
FIG. 2 is a diagrammatic cross-sectional view of an instrument employed for measuring a melt viscosity of hot-melt polyester, partly shown by hatching for making it easy to understand the construction.
Figure 3:
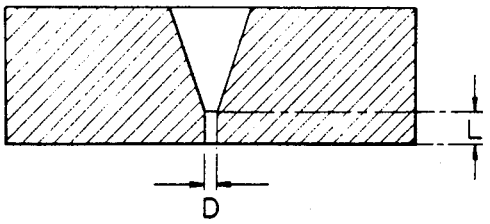
FIG. 3 is an enlarged cross-sectional view of a nozzle disposed in the equipment of FIG. 2.

2. Melt Viscosity (Reference should be made to FIGS. 2 and 3)

1. Definition

A predetermined load is loaded upon a sample of a molten polymer through the plunger of a flow tester thereby to extrude the molten polymer through the orifice of a nozzle at the bottom of a cylinder. The distance and time of descent of the plunger are measured. The melt viscosity of the sample polymer is calculated according to the following equation (1):

$$\text{Melt Viscosity (centipoises)} = \frac{T}{H} \times P \times K \quad (1)$$

wherein

T is a time (sec) of descent of the plunger;

H is a distance (cm) of descent of the plunger;

P is a load (g); and

K is a constant determined according to the following equation (2):

$$K = \frac{9.8}{2} \times 10^4 \times \frac{(D/2)}{L} \times \frac{(D/2)^3}{4} \pi \quad (2)$$

wherein

L is a length (cm) of the orifice; and

D is a diameter (cm) of the orifice.

2. Measurement

A Koka Type Flow Tester Model 301 (trade name of a product manufactured and sold by Shimadzu Seisakusho Ltd., Japan) is used for the measurement of melt viscosity. A sample polyester 26 is charged into a cylinder 22 (made of stainless steel) located in the center of a heating medium 21 (made of stainless steel) heated at a predetermined temperature by means of a band heater 25. 3 Minutes after charging of the sample polyester, a predetermined load is loaded upon the sample polyester through a plunger 23 to extrude the sample polyester in the direction indicated by an arrow through an orifice 27 of a nozzle 24 (made of stainless steel) at the bottom of the cylinder. The distance of descent of the plunger and the time required for descent of the plunger are measured. The melt viscosity of the sample polyester is calculated according to the equations as described in Definition above.

The cross-section area of the cylinder is 1 $cm^2$ and the internal volume of the cylinder is 1 $cm^3$. The length (L) of the orifice is 2.25 mm and the diameter (D) of the orifice is 0.45 mm.

In the following Examples, the names of raw materials are abbreviated as follows.

DMT: dimethyl terephthalate
IPA: isophthalic acid
SUA: succinic acid
GA: glutaric acid
ADA: adipic acid
AZA: azelaic acid
SEA: sebacic acid
DDA: 1,10-decanedicarboxylic acid
BCPE: 1,2-bis(p-carbomethoxyphenoxy)ethane
EG: ethylene glycol
1,2-PD: 1,2-propanediol
1,3-PD: 1,3-propanediol
1,4-BD: 1,4-butanediol
1,5-PED: 1,5-pentanediol
1,6-HD: 1,6-hexanediol
NPG: neopentyl glycol
DEG: diethylene glycol
PEG: polyethylene glycol (molecular weight: 6,000)
BA: bisphenol A
HEPP: 2,2'-bis[p-(β-hydroxyethoxy)phenyl]propane

REFERENTIAL EXAMPLE (SYNTHESIS OF HOT-MELT POLYESTER)

To 125 parts by weight (0.64 mole) of dimethyl terephthalate were added 148 parts by weight (1.64 moles) of 1.4-butanediol and 0.22 parts by weight (0.0007 mole) of tetraisopropyl titanate as a catalyst. The resulting mixture was heated to 180°-220° C. under a stream of nitrogen in a reactor. Under the reflux of 1,4-butanediol, the formed methanol was completely distilled off to effect the ester interchange reaction. To the reaction product were then added 64 parts by weight (0.39 mole) of isophthalic acid and 49 parts by weight (0.34 mole) of adipic acid. The resulting mixture was subjected to esterification at 220° C. for 2 hours under the reflux of 1,4-butanediol while removing the formed water out of the reaction system. The esterification reaction product was heated from 220° C. to 240° C. over one hour while the pressure of the system was slowly reduced to 0.1 mmHg. Thereupon, the thus obtained product was polycondensed at 240° C. under 0.1 mmHg for 2 hours to prepared a polyester A, which was found to have a softening point of 136° C. and a melt viscosity of 6,000 centipoises at 166° C.

Substantially the same procedures as mentioned just above were repeated except that the acid components and the glycol component were varied, thereby to prepare polyesters B to V. That is, a given amount of dimethyl terephthalate or a mixture of dimethyl terephthalate and 1,2-bis(p-carbomethoxyphenoxy)ethane was subjected to an ester interchange reaction with a glycol components in an amount more than twice the molar amount of the methyl ester or the methyl esters and more than 1.5 times that of the total carboxylic acid components in the presence of tetraisopropyl titanate in an amount 0.0005 times the total molar amount of the carboxylic acid components. The remaining carboxylic acids were then added to the thus obtained reaction products to effect the esterification reaction and, in turn, the polycondensation reaction. The polyethylene glycol, bisphenol A and 2,2'-bis[p-(β-hydroxyethoxyl)-phenyl]propane were added after the esterification reaction and the ester interchange reaction, respectively.

The components of each of the polyesters and the softening point and melt viscosity thereof are shown in Table 1.

EXAMPLE 1

Each of the hot-melt polyesters obtained in Referential Example was coated onto a pencil barrel on a laboratory scale according to the following procedures. The polyester was introduced into a test tube haing a bore of 30 mm. The test tube was immersed in a silicone oil bath maintained at a temperature 30° C. higher than the softening point of the polyester to melt the polyester. After the polyester was completely molten, the test tube was provided on its inlet with a hollow wiping rubber die for removal of excess molten polyester. The pencil barrel was plunged through the hollow portion of the die in the molten polyester, so that it was dipped in the molten polyester, and then withdrawn therefrom. Several seconds later, a uniform coating film having a thick-

TABLE 1

| | Polyesters | | | | | | | | | | | | |
|---|---|---|---|---|---|---|---|---|---|---|---|---|---|
| | Acid components, mole % | | | | | | | | | Glycol, mole % | | | |
| No. | DMT | IPA | SUA | GA | ADA | AZA | SEA | DDA | BCPE | EG | 1,2-PD | 1,3-PD | 1,4-BD |
| A | 47 | 28 | | | 25 | | | | | | | | 100 |
| B | 62 | 23 | | | 15 | | | | | | | | 100 |
| C | 53 | 14 | | | 33 | | | | | | | | 100 |
| D | 47 | 33 | | | 20 | | | | | | | | 100 |
| E | 30 | 40 | | | 30 | | | | | | | | 100 |
| F | 53 | 37 | 5 | 5 | | | | | | | | | 100 |
| G | 50 | 30 | | | | 20 | | | | | | | 100 |
| H | 50 | 30 | | | | | 20 | | | | | | 100 |
| I | 50 | 30 | | | | | | 20 | | | | | 100 |
| J | 56 | 19 | | | 25 | | | | | 100 | | | |
| K | 53 | 15 | | | 32 | | | | | 100 | | | |
| L | 53 | 37 | 5 | 5 | | | | | | | | 100 | |
| M | 90 | | | | 10 | | | | | | | | |
| N | 53 | 32 | | 5 | | | | | 10 | 100 | | | |
| O | 47 | 13 | | | 40 | | | | | | | | 99.7 |
| P | 53 | 32 | | | 15 | | | | | 96 | | | |
| Q | 53 | 22 | | | 15 | | | | | 96 | | | |
| R | 100 | | | | | | | | | | | | |
| S | 100 | | | | | | | | | | | | |
| T | 100 | | | | | | | | | | | | |
| U | 100 | | | | | | | | | | 100 | | |
| V | 100 | | | | | | | | | | | | |
| W | Toyobo Byron GX-150 (made by Toyobo Co., Ltd., Japan) | | | | | | | | | | | | |
| X | DYNAMIT Nobel L 1850 (made by DYNAMIT Nobel AG., West Germany) | | | | | | | | | | | | |

| | Polyesters Glycol, mole % | | | | | | | Properties | |
|---|---|---|---|---|---|---|---|---|---|
| No. | 1,5-PED | 1,6-HD | NPG | DEG | PEG | BA | HEPP | Softening point, °C. | Melt*1 viscosity, centipoises |
| A | | | | | | | | 136 | 6,000 |
| B | | | | | | | | 164 | 14,000 |
| C | | | | | | | | 145 | 12,000 |
| D | | | | | | | | 143 | 8,500 |
| E | | | | | | | | 87 | 15,000 |
| F | | | | | | | | 137 | 8,500 |
| G | | | | | | | | 132 | 10,000 |
| H | | | | | | | | 130 | 10,000 |
| I | | | | | | | | 129 | 10,000 |
| J | | | | | | | | 154 | 17,000 |
| K | | | | | | | | 132 | 16,000 |
| L | | | | | | | | 135 | 9,000 |
| M | | 100 | | | | | | 150 | 15,000 |
| N | | | | | | | | 87 | 7,100 (135° C.) |
| O | | | | | 0.3 | | | 128 | 8,500 (135° C.) |
| P | | | | | | 4 | | 90 | 7,300 (130° C.) |
| Q | | | | | | | 4 | 79 | 6,000 (135° C.) |
| R | 100 | | | | | | | 130 | 12,000 |
| S | | 100 | | | | | | 164 | 20,000 (195° C.) |
| T | | | | 100 | | | | 85 | 8,000 |
| U | | | | | | | | 110 | 15,000 |
| V | | | 100 | | | | | 142.5 | 10,000 (175° C.) |
| W | | | | | | | | 177 | 4,000 (200° C.)*2 |
| X | | | | | | | | 134 | 54,700 (200° C.)*2 |

Note
*1Melt viscosities as measured at a temperature 30° C. higher than the melting point except those with parenthesized temperatures
*2Products available in the market ness of several-ten microns was formed uniformly over the surface of the barrel. The thickness of the obtained film on the order of several tens microns is comparable to that of the conventional lacquer film having a 50% solids content and formed by repeating the coating operation several times.

All the polyesters obtained in Referential Example gave a several tens microns-thick coating film by only a single coating, and could be coated onto a pencil barrel with high productivity.

In the case of polyesters A to I, and L and M, no blocking was observed between the adjacent pencils immediately upon coating. Especially when polyesters A to D and F to I were used, a practical coating film could be formed in a shorter period of time, i.e. at a higher coating rate without causing any blocking.

The above-mentioned procedures were repeated using the coating process illustrated in FIG. 1. It was confirmed that the same results can be obtained.

Illustratively stated, each of polyesters A to D and F to I was charged into a XI type hot-melt applicator 9 (manufactured and sold by Nordson Corp., U.S.A.), and then molten at a temperature 30° C. higher than the softening point thereof. The molten polyester was fed into a hot-melt coating vessel 5 having a depth of 15 cm and a width of 5 cm. The vessel was lagged with an insulated jacket 7 having therein a silicone oil heated to a temperature 30° C. higher than the softening point of the polyester used. Subsequently, uncoated pencil barrels 3 stored in the hopper 2 were pushed out at a rate of one barrel per second by a plunger rod 1, supplied into the coating vessel 5 through the feed roll 4 and continuously coated with the polyester. The thus coated pencil barrels were transferred to the conveyor 10 and cooled in the course of transportation, thereby to form a several tens micron-thick coating film uniformly on the surfaces thereof. It was affirmed that the time required for formation of the film is extremely short, viz. 2 to 3 seconds without occurrence of blocking between the adjacent pencils carried by the conveyor, and therefore, continuous coating can be effected with high productivity.

EXAMPLE 2

80 Parts by weight of each of polyesters A to K obtained in Referential Example were charged into a flask equipped with a stirrer, together with 20 parts by weight of rutile type titanium dioxide having an average particle size of 1μ. The flask was immersed in an oil bath maintained at 220° C. to mix the polyester with the titanium dioxide in a molten state.

The polyester thus admixed with the titanium dioxide was examined on the properties of the coating film formed on the pencil barrel according to the same procedures as employed in Example 1. As a result, it was found that, like Example 1, each polyester can give a uniform coating film having a thickness of several tens microns by a single coating.

An additional dip coating of lacquer (in the form of a 30% ethyl acetate solution containing nitrocellulose, vinyl acetate resin and plasticizer) onto the obtained polyester films gave glossy pencils. These pencils were subjected to Scotch tape testing, but showed no sign of peeling of the lacquer films. These pencils were sharpened by means of a knife, a manually operated pencil sharpener and an electrically operated pencil sharpener, respectively, but any of them showed no sign of peeling of the coating film from the pencil barrel and cracking thereof. Use of enamel lacquer prepared by admixing a coloring pigment kneaded with castor oil with the above-mentioned lacquer also gave similar results. On the other hand, a bundle of these pencils were allowed to stand in an atmosphere of 50° C. and 80% R.H. for one month, but showed no sign of any furface change.

EXAMPLE 3

The higher alcohol, higher fatty acid, fat and oil, wax, inorganic filler, and, optionally, coloring pigment specified in Table 2 were added to each of the polyesters A to K obtained in Referential Example. The above additives were employed alone or in combination of two or more thereof according to the following procedures.

Given amounts of the polyester and additives were placed in a 500 ml glass container equipped with a stirrer, which was in turn immersed in an oil bath maintained at 220° C. to prepare a mixture thereof in a molten state.

The thus obtained polyester mixtures were coated onto pencil barrels according to Example 1 to examine the smoothness of the resulting films. The results are given in Table 2. Further, the pencil barrels were coated with the lacquer and enamel lacquer according to Example 2, and then subjected to Scotch tape testing. The results are also shown in Table 2.

TABLE 2

(Formulation and effect)

| | Run No. | | | | | | | | | | |
|---|---|---|---|---|---|---|---|---|---|---|---|
| Components | 1 | 2 | 3 | 4 | 5 | 6 | 7 | 8 | 9 | 10 | 11 |
| Hot-melt polyester | 79.5 | 75 | 60 | 65 | 90 | 80 | 70 | 75 | 80 | 100 | 45 |
| Low molecular weight polyethylene | | | | 25 | | 5 | 25 | | | | 4 |
| Stearic acid | | | | | | | | 5 | | | |
| Oleic acid | | | | | | 15 | | 5 | | | |
| Castor oil | | | | | 10 | | 5 | | | | |
| Dioctyl phthalate | | 5 | | | | | | | | | 1 |
| Dibutyl sebacate | 0.5 | | | | | | | | 5 | | |
| Talc | 10 | 10 | | | | | | | 5 | | 40 |
| Kaolin | | | 30 | | | | | 5 | | | |
| Coloring pigment | 10 | 10 | 10 | 10 | | | | | 10 | | 10 |
| Total | 100 | 100 | 100 | 100 | 100 | 100 | 100 | 100 | 100 | 100 | 100 |
| Effect Smoothness of coating film | ◎ | ◎ | ○ | ◎ | ◎ | ◎ | ◎ | ◎ | ◎ | Δ | ◎ |

TABLE 2-continued (Formulation and effect)

| Components | Run No. 1 | 2 | 3 | 4 | 5 | 6 | 7 | 8 | 9 | 10 | 11 |
|---|---|---|---|---|---|---|---|---|---|---|---|
| Adhesion to | ◎ | ◎ | ◎ | X | ◎ | ○ | X | Δ | ◎ | ○ | ◎ |

◎ Excellent
Δ Slightly poor
○ Good
X Poor

What is claimed is:

1. A method of coating a pencil which comprises applying onto the surface of a pencil capable of being sharpened by means of a sharpener, without the use of a solvent, a hot-melt polyester prepared from carboxylic acid components and alcohol components, which is molten at a temperature higher than the softening point thereof, followed by cooling for solidification of the hot-melt polyester; the hot-melt polyester having a softening point of 70° to 200° C. and a melt viscosity of 100 to 100,000 centipoises as measured at a temperature 30° C. higher than the softening point of said polyester; and comprising, as carboxylic acid components, 40 to 65 mole % of terephthalic acid monomer units, 10 to 40 mole % of isophthalic acid monomer units and 10 to 40 mole % of monomer units of at least one saturated dicarboxylic acid selected from the group consisting of straight chain or branched saturated aliphatic dicarboxylic acids having 4 to 12 carbon atoms, and as alcohol components, 1,4-butanediol monomer units.

2. A method according to claim 1, wherein said hot-melt polyester has an additive incorporated therein.

3. A method according to claim 2, wherein said additive is a member selected from the group consisting of a higher alcohol, a higher fatty acid, a fat and oil, a wax, a resin, a metallic soap, a liquid polymer, an oligomer, a plasticizer and mixtures thereof and is employed in an amount of 0.5 to 20% by weight based on the final hot-melt polyester.

4. A method according to claim 3, wherein said additive is a member selected from the group consisting of a higher alcohol, a higher fatty acid, a fat and oil, a wax, a plasticizer and mixtures thereof.

5. A method according to claim 2, wherein said additive is a member selected from the group consisting of a coloring agent, an inorganic filler, an organic filler and mixtures thereof and is employed in an amount of 5 to 60% by weight based on the final hot-melt polyester.

6. A method according to claim 2, wherein said additive comprising 0.5 to 20% by weight, based on the final hot-melt polyester, of a member selected from the group consisting of a higher alcohol, a higher fatty acid, a fat and oil, a wax, a plasticizer and mixtures thereof and 0.5 to 60% by weight, based on the final hot-melt polyester, of a member selected from the group consisting of a coloring agent, an inorganic filler, an organic filler and mixtures thereof.

7. A method according to claim 1, wherein the application of the molten hot-melt polyester onto the pencil is effected by feeding a pencil into a coating vessel maintained at a predetermined temperature by means of a heat medium and having therein a molten hot-melt polyester maintained at a constant level with respect to a depth of the molten polyester, passing the pencil through said molten polyester and removing excess hot-melt polyester from the resulting pencil barrel by means of a wiping die.

8. A method according to claim 1, which further comprises, after solidification of the hot-melt polyester, applying to the surface of the polyester-coated pencil a lacquer.

9. A method according to claim 8, wherein the lacquer has a synthetic resin useful as a coating material component incorporated therein.

10. A method according to claim 8, wherein the lacquer is an enamel lacquer containing a pigment and/or a dye.

* * * * *